United States Patent [19]

Hauser

[11] 3,993,415

[45] Nov. 23, 1976

[54] FAN WITH FLUID FRICTION CLUTCH

[75] Inventor: Kurt Hauser, Stuttgart, Germany

[73] Assignee: Suddeutsche Kuhlerfabrik, Julius Fr. Behr, Stuttgart, Germany

[22] Filed: Dec. 19, 1974

[21] Appl. No.: 534,238

[30] Foreign Application Priority Data

Jan. 12, 1974 Germany ..... 2401462

[52] U.S. Cl. ..... 416/93 R; 416/201 A; 416/203; 416/245 R; 123/41.49; 192/113 A

[51] Int. Cl.[2] ..... B63H 1/20

[58] Field of Search ..... 416/93, 201, 175, 203, 416/201 A, 245; 192/113 A, 58 A, 58 B, 58 C; 123/41.2, 41.48, 41.49; D23/165

[56] References Cited

UNITED STATES PATENTS

| | | | |
|---|---|---|---|
| 3,250,355 | 5/1966 | Weir | 192/58 B |
| 3,385,516 | 5/1968 | Omohundro | 416/93 |
| 3,758,231 | 9/1973 | Barnstead | 416/93 UX |
| 3,885,888 | 5/1975 | Warhol | 416/201 X |
| D110,876 | 8/1938 | Preston | D23/165 |
| D131,271 | 2/1942 | Collura | D23/165 |

*Primary Examiner*—Harold W. Weakley
*Attorney, Agent, or Firm*—Browdy and Neimark

[57] ABSTRACT

In a fan with a fluid friction clutch wherein the housing of the clutch is connected with the fan or has fan blades attached thereto and wherein the surface of the clutch housing facing the air intake opening of the fan is provided with cooling ribs to carry off slippage heat, the improvement comprises flow direction means for reducing the effects of the secondary air flow around the clutch housing. The flow directing means comprise either the cooling ribs on the surface of the clutch housing facing the air intake opening of the fan which ribs are curved at the outer edges thereof in a direction reverse to that of the rotation of the fan; cooling ribs of construction angled in reverse direction to that of the direction of rotation of the fan; annular cooling ribs; or cooling ribs of conventional radial arrangement covered by a flow directing intake housing.

1 Claim, 4 Drawing Figures

FAN WITH FLUID FRICTION CLUTCH

FIELD OF THE INVENTION

The invention concerns an improvement in a fan with a fluid friction clutch, especially for cooling internal combustion engines, whose clutch housing is connected to the fan and has fan blades attached to it by casting, riveting or screwing, and whose surface is provided with cooling ribs to get rid of the heat produced by slippage.

BACKGROUND OF THE INVENTION

Such fans are used particularly for cooling internal combustion engines. Fluid friction clutches used for this purpose must be able to provide the required level of cooling by changing the drive rate or fan speed to modify the amount of cooling air provided by the fan. The rotational speed is controlled by a temperature sensor as a function of the temperature of the cooling water or cooling air, or by virtue of centrifugal force as a function of engine rpm. The degree of filling and therefore the degree of coupling are thus controlled, resulting in a change of the rotational moment which can be transmitted by the clutch. Depending on the degree of filling, the slippage of the clutch will vary, said slippage being equal to the difference between the rotational speed of the drive and the rotation speed of the fan. The result is a "slippage power," which results in a rise in the temperature of the viscous fluid transmitting the rotational moment.

The same conditions also apply to a so-called fluid friction clutch with limited rotational moment. In this design, the clutch is arranged so that only a moment which corresponds to the maximum permissible fan rpm will be transmitted. With a further increase in engine speed, the fan rotational speed will not increase or will increase only slightly. In this case also, a "slipping power" results, imposing a corresponding thermal load on the clutch.

In order not to overheat the viscous liquid and to keep bearing temperature within acceptable limits, the heat resulting from slipping must be dissipated into the surrounding air. For this reason, clutches of this type are provided with appropriate cooling ribs which are located particularly on the front of the clutch or on the back of the clutch and on the circumference of the clutch housing.

In known embodiments, the cooling ribs on the front and back of the clutch are arranged radially. In a known fluid friction clutch with temperature-controlled filling regulation, the clutch is provided on the cover side with cooling ribs, some of which run radially and some of which are slightly curved. Both rib shapes have the disadvantage that they produce a significant secondary air flow which cuts down the main flow from the fan hub.

Measurements with such cooling fans have shown that the downstream flow rate of the secondary flow at the periphery of the clutch may be significantly above the rate of the flow produced by the fan itself. The resultant reduction of the flow at the fan hub leads to a reduction of the air delivery rate and the degree of efficiency of the fan, and to an increase in the noise level as well.

Cooling ribs located on the back of the clutch, running radially or predominantly radially, also produce an additional flow, but the disturbing influence in this case is much less, since the main flow is deflected by the internal combustion engine in any case, in a radial or semiaxial direction. Moreover, the air flow produced by the cooling ribs is throttled by structural elements in the clutch, especially the coupling flange.

The secondary air flow produced by the cooling ribs on the front of the clutch, in contrast to a fan without this kind of flow, leads to a decrease in efficiency of 10–15 percent and, with the same air flow, a 10–15 percent higher power requirement for the fan. The noise level increases approximately 3 dB (A).

SUMMARY OF THE INVENTION

The goal of the invention is to eliminate the initially described disadvantages, and to do away with the secondary air flow to the maximum possible extent, at least by appropriate channeling of the secondary air flow, whose influence on the main flow must be reduced.

This goal is achieved according to the invention with a fan of the type described hereinabove, mainly by virtue of the fact that the cooling ribs on the front of the clutch, at least in the outer area, are curved sharply backwards against the direction of rotation or are made in the form of straight ribs which slope against the rotational direction. By this means, a reduction of secondary flow is achieved.

According to a further feature of the invention, it is advantageous if the exit angle $\beta$ measured with respect to the circumference is less than 55°. The propulsive action of the cooling ribs therefore decreases as the angle $\beta$ decreases. A reduction of secondary flow will result in a reduction of heat transfer, but the latter will be compensated for by the fact that greater rib area can be provided.

According to a modified sample embodiment of the invention, the front of the clutch housing is provided with annular cooling ribs. Such annular cooling ribs do not produce any secondary flow and can be used in both rotational directions.

According to a further embodiment of the modified embodiment of the invention, it is advantageous to have short radial ribs provided at the center of the clutch housing. It has been found to be advantageous to interrupt the annular ribs at certain points, so that at these points the flow produced by the short radial ribs can break up the boundary layer which forms on the annular surface.

According to still another exemplary embodiment of the invention, the cooling ribs, which are not annular but, for example, radial in a curved or sloping pattern on the front of the clutch, are covered by a housing in such fashion that the air produced by the cooling ribs can enter on opening in the center of the housing and be guided by the housing in such fashion that the air flows out at the circumference of the clutch housing or the hub of the fan in an axial or nearly axial direction, and that the diameter of this housing is larger than the diameter of the clutch or fan hub, so that a sufficiently large annular space is produced at the air outlet.

According to a modification of the still another embodiment of the invention it is advantageous to have the intake housing provided with a chamfer at the transition to the cylindrical or predominantly cylindrical form. The resultant powerful secondary air flow ensures good cooling of the housing jacket. This sample embodiment is also advantageous in clutches that are subject to high thermal stress.

BRIEF DESCRIPTION OF THE DRAWING

Further advantages and features of the invention will be seen in greater detail from the drawings which show schematic sample embodiments.

DETAILED DESCRIPTION OF THE PREFERRED EMBODIMENTS

Figure 1:
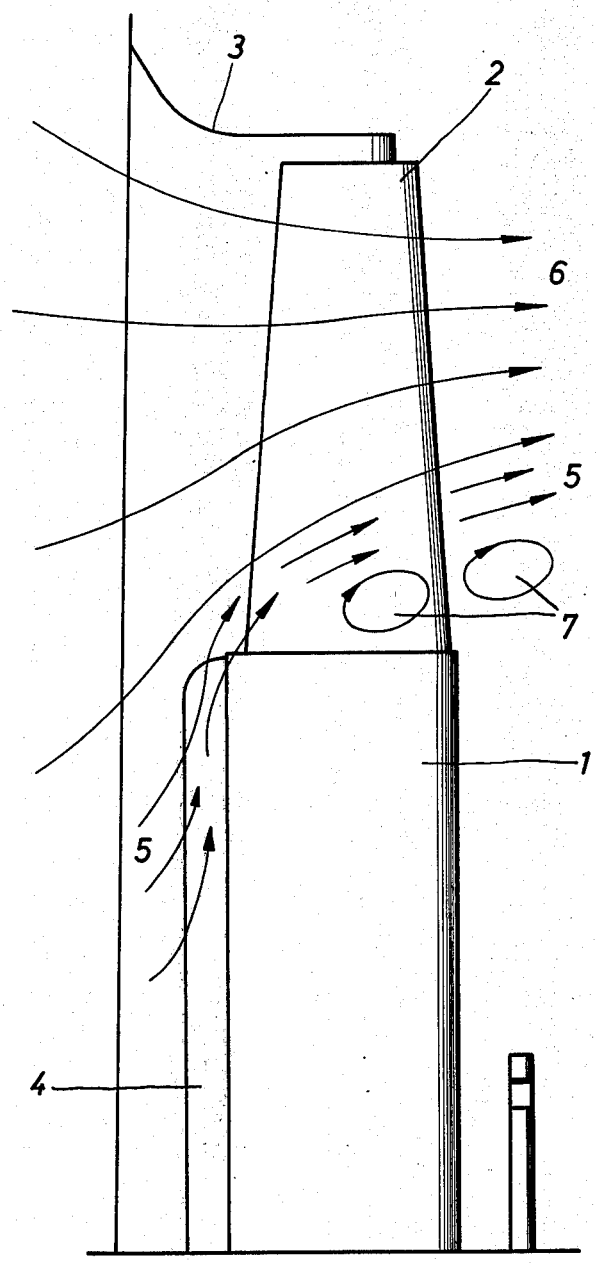
FIG. 1 is a cooling rib design in a fan according to the state of the art.

In FIG. 1, a fan according to the state of the art is shown schematically and in partial cross section. Fan blades 2 have been cast on a clutch housing 1. The fan is enclosed in a flame 3. On the front of the clutch, radial cooling ribs 4 have been provided. The secondary air flow stream produced by cooling ribs 4 is indicated by 5, while 6 represents the main flow. As a consequence of the decrease in flow at the fan hub or in the clutch housing, air vortices 7 result. This breakup of the flow at the fan hub leads to a reduction of air flow and fan efficiency, and to an increase in noise level as well.

Figure 2:
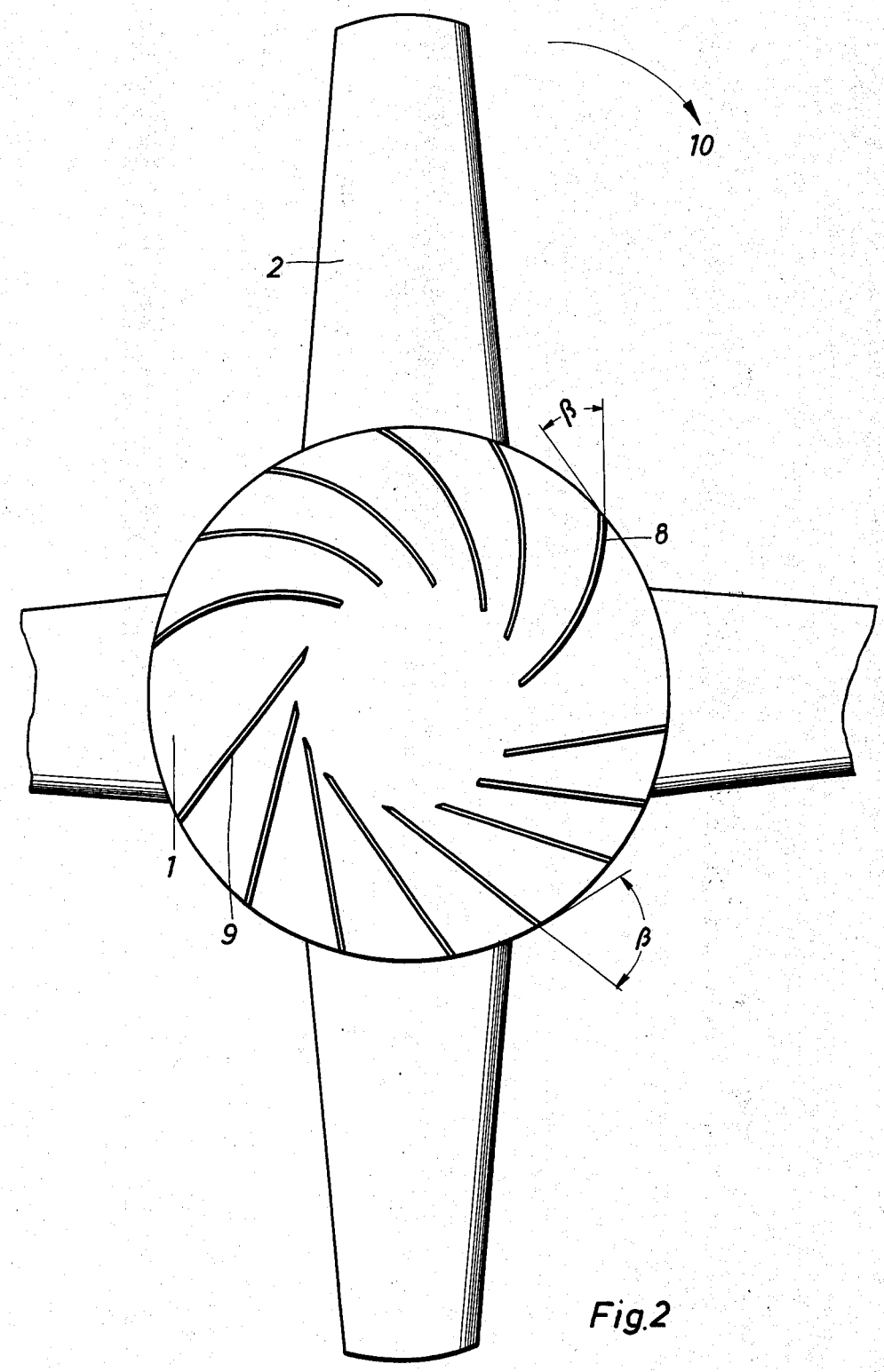
FIG. 2 is a first exemplary embodiment of the invention.

A first exemplary embodiment of the invention is shown in FIG. 2. Here cooling ribs 8 have been provided on the front or air intake side of clutch housing 1, said ribs being inclined backward opposite the direction of rotation of fan blades, or cooling ribs 9 have been provided, inclined backward. The angle of emergence of the cooling ribs measured relative to the circumference in represented by $\beta$. The arrow 10 shows the direction of rotation of the fan as seen from the direction of the intake of the incoming air. Angle $\beta$ is advantageously selected to be less than 55°. The propulsive effect of the rib shape in FIG. 2 decreases as angle $\beta$ decreases. The rib shapes in FIG. 2 are advantageously applicable to only one rotational direction.

Figure 3:
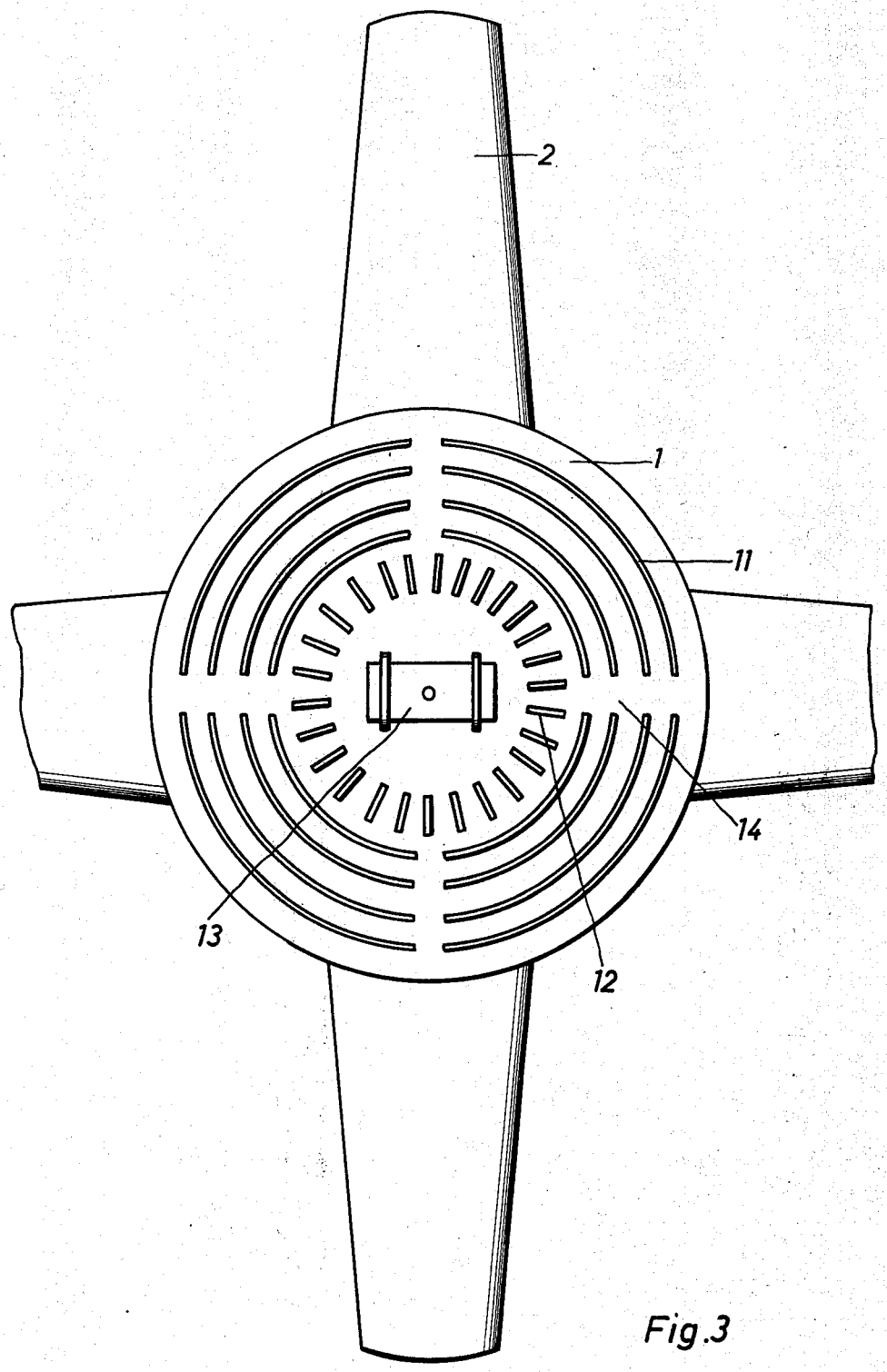
FIG. 3 is a second exemplary embodiment of the invention.

In the exemplary embodiment of the invention shown in FIG. 3, annular cooling ribs 11 are used, which produce no secondary flow and can be used in both rotational directions. In this case, it is advantageous to provide additional short radial ribs 12 at the center of the clutch housing, in order to enable to produce movement of the air around the temperature sensor 13 mounted in this position. In addition, it has also been proven to be advantageous to interrupt these annular ribs 11 at certain points 14, so that at these points 14 the flow produced by the short radial ribs 12 can break up the boundary formed on the annular surface of the ribs.

This interruption of the ribs, even with backward-curved or sloped cooling ribs 8 or 9, described hereinabove, can have a favorable effect upon heat transfer, without producing additional cross flow. The breakup of the boundary layer at the points of interruption causes an increase in heat transfer to the rib surfaces and thus improves the liberation of heat from slippage.

Figure 4:
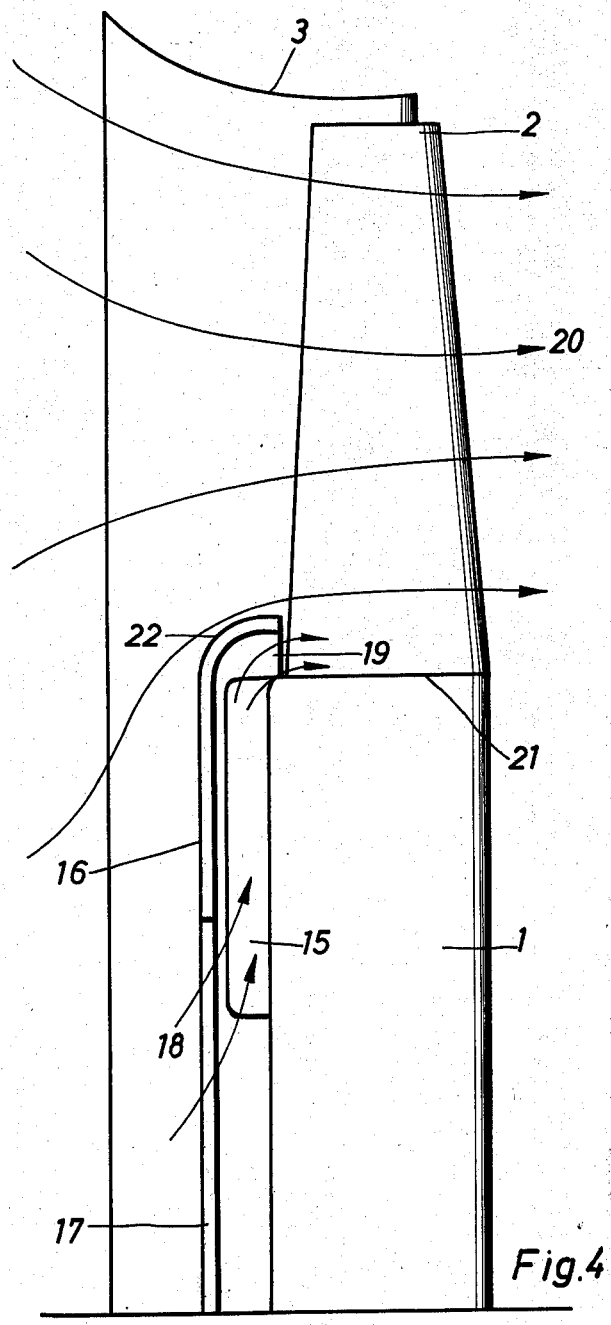
FIG. 4 is a further exemplary embodiment.

Still another exemplary embodiment of the invention is shown in FIG. 4. In this exemplary embodiment, deflection of the secondary air flow in the axial direction is effected to reduce the disturbing influence of the secondary flow. This is accomplished according to the invention by using a housing 16 to cover the cooling ribs 15 which are non-annular, for example, radial; and slope forward or backward on the front of the clutch. Housing 16 has a concentric intake opening 17, through which a flow of cooling air 18 is drawn. The air flow produced by the feed action of the ribs is deflected into the axial direction by the housing 16 which is provided at its outside diameter by a chamfer 22 and makes a transition to a cylindrical or predominantly cylindrical shape. The diameter of the housing 16 is larger than the diameter of the clutch housing 1, so that the result is an annular opening 19 through which secondary air can flow out in an axial or semiaxial direction.

Since the rate of emergence of the secondary air flow 18 is much greater than the flow velocity of the main flow 20, the application of the main flow to the fan hub is favored, so that a relatively small chamfer radii of intake housing 16 will suffice, which has an advantageous effect upon the structural thickness of the fan. The powerful secondary air flow also ensures good cooling of housing jacket 21. This embodiment is also particularly advantageous in the case of clutches that are subject to high thermal stress.

The invention is not limited to the exemplary embodiments shown and described herein. It also covers all modifications made by experts in the field as well as partial and subcombinations of the features and measures described and/or shown.

What is claimed is:

1. In a fan having an axis of rotation and a fluid friction clutch, especially for cooling internal combustion engines, wherein the clutch housing of said clutch is connected with the fan or has fan blades attached thereto and wherein a front surface of said clutch housing facing the air intake opening of the fan is provided with arcuate cooling ribs to carry off the slippage heat developed in the clutch, the improvement wherein said arcuate cooling ribs have an arcuate length many times there radial width and are disposed on said front surface of said clutch housing in the form of concentric circles radially displaced from said axis of rotation, said arcuate cooling ribs being interrupted at several points around the circumferences thereof; and including additional unconnected radial cooling ribs disposed within said circles at the center of said front of said clutch housing.

* * * * *